US005605068A

United States Patent [19]

Yamasoto et al.

[11] Patent Number: 5,605,068

[45] Date of Patent: Feb. 25, 1997

[54] APPARATUS FOR ROLLING A RING-SHAPED WORK

[75] Inventors: Takao Yamasoto, Nagoya; Hirokazu Ishiyama, Chita, both of Japan

[73] Assignee: Daido Tokushuko Kabushiki Kaisha, Nagoya, Japan

[21] Appl. No.: 443,420

[22] Filed: May 18, 1995

[51] Int. Cl.[6] ..... B21H 1/06

[52] U.S. Cl. ..... 72/105; 72/110

[58] Field of Search ..... 72/68, 105, 106, 72/110, 111, 349

[56] References Cited

U.S. PATENT DOCUMENTS

| | | | |
|---|---|---|---|
| 1,661,024 | 2/1928 | Venable | 72/111 |
| 3,190,098 | 6/1965 | Wilson | 72/101 |
| 3,943,740 | 3/1976 | Bartenstein | 72/349 |
| 4,672,833 | 6/1987 | Bartko et al. | 72/111 |
| 4,869,088 | 9/1989 | Kadotani | 72/10 |

FOREIGN PATENT DOCUMENTS

| | | | |
|---|---|---|---|
| 59-212142 | 12/1984 | Japan | B21H 1/12 |

*Primary Examiner*—Lowell A. Larson
*Attorney, Agent, or Firm*—Ronald R. Snider

[57] ABSTRACT

A work 12 is selectively loaded one of forming portions 20, 22, and so on, which are formed on a mandrel 18. Then, the work 12 is pressed between the selected forming portion and a forming roll 10 and rotated together with the forming roll 10 and the mandrel 18 in this state, thereby rolled and formed a groove on its inner surface. The mandrel 18 is provided movably in its axial direction, and the forming portions 20, 22, and so on, are subsequently selected for rolling the work 12 step by step. After finishing the rolling, the work 12 is unloaded from the mandrel 18, guided by a work guiding passage, and is supplied to the sizing device 120, wherein the work 12 is pushed into a die 121 and sized the outer diameter thereof.

21 Claims, 11 Drawing Sheets

APPARATUS FOR ROLLING A RING-SHAPED WORK

FIELD OF INVENTION

This invention relates to an apparatus for rolling a ring-shaped work, such as an outer race of a ball bearing and a gear element, by using a forming roll and a mandrel.

BACKGROUND OF INVENTION

FIG. 12 illustrates a typical process in the prior arts for forming a ring-shaped work having a ring-like groove on its inner surface (such as an outer race of a ball bearing). A ring-shaped work (which will be called merely "work" hereinafter) 202 is pressed between a roll 203 and a mandrel 206 at the outer and inner surfaces thereof, rolled due to the rotation of the roll 203 and the mandrel 206, and formed a groove 200 on its inner surface by a forming portion having a convex profile 208 formed on the mandrel 206.

In the method described above, forming a deep groove on the work 202 in one step may become difficult since a too drastic deformation of the work 202 causes a decrease in mechanical accuracy of the work 202. Therefore, as shown in FIG. 11, a deep groove has been formed according to such a procedure comprising two or more steps of subsequent rolling of a relatively small degree of deformation. Such procedure, however, requires a plurality of rolling apparatus corresponding to the number of the forming steps, thereby causing an increase in the cost and space of the production facilities. Furthermore, the productivity may decrease since loading and unloading of the work 202 to the apparatus should be repeated for each step of the rolling.

The object of this invention is to offer an apparatus for rolling a ring-shaped work which improves the efficiency of such multistep rolling process and the mechanical accuracy of the work.

SUMMARY OF THE INVENTION

For solving the aforementioned object, the apparatus relating to this invention comprises following matters:

(1) A forming roll contacted with the outer surface of a ring-shaped work.

(2) A mandrel provided movably in the axial direction thereof.

(3) A plurality of forming portions formed on the outer surface of said mandrel. These forming portions are arranged at an arbitrary distance along the axial direction of said mandrel, and one of them is selected according to the moving distance of said mandrel in said axial direction, and said selected forming portion is contacted with the inner surface of said work for rolling the work with a cooperation of said forming roll.

(4) A mandrel driving device which drives said mandrel in said axial direction for selecting one of said forming portions.

(5) A work holding device which holds said work for making a gap between said work and said forming portions when said mandrel is axially moved for selecting one of said forming portions.

In a more specific constitution, at least two of said forming portions can be subsequently selected for rolling said work step by step. Furthermore, each said forming portion can be provided for forming a different depth of groove on the inner surface of said work and selected subsequently for rolling said work step by step in the order of increasing the depth of said groove.

In the constitution mentioned above, necessary forming portions are subsequently selected for performing the rolling step by step, so that the whole process of the rolling can be carried out more efficiently by using only one apparatus. Furthermore, the productivity of rolling may increase since work loading and unloading on and from the apparatus is required only one time.

Following matters can be added to the constitution mentioned above.

(1) A first mandrel supporting portion which rotatably supports one end portion of said mandrel.

(2) A second mandrel supporting portion which rotatably supports the other end portion of said mandrel and can move to and from said other end portion.

Furthermore, the apparatus can comprise an auxiliary mandrel driving device. This device drives said first mandrel supporting portion together with said mandrel in said axial direction for loading and unloading said work on and from said mandrel from said other end portion. Said mandrel driving device drives said first and second mandrel supporting portions together with said mandrel in said axial direction. According to this constitution, loading and unloading the work to and from the mandrel can be easily performed at the state that the end portion of the mandrel is disconnected from the second mandrel supporting portion.

The apparatus can comprise following matters.

(1) A forming roll shaft wherein said forming roll is mounted on one end portion thereof.

(2) A bearing portion which rotatably supports said forming roll shaft at the opposite side of said end portion.

(3) A supporting portion which supports said bearing portion and extends in the direction away from said forming roll.

According to this constitution, the forming roll shaft is supported at one side thereof, so that the bearing portion decreases its space of occupation and reduces the size of apparatus, and loading and unloading of the work becomes easier. In this case, the forming roll can be removably mounted on said one end portion of said forming roll shaft, and both mounting surfaces of said forming roll shaft and said forming roll can be tapered so that the diameters of said mounting surfaces increase along the direction of mounting said forming roll on the forming roll shaft, for making the forming roll to be easily dismounted from the shaft.

On the other hand, the apparatus can also comprise a backup roll which is provided corresponding to said forming roll and urged against said mandrel from the opposite side of said forming roll, thereby receiving the pressure from said forming roll when said ring-shaped work is rolled. In this constitution, following matters can be added corresponding to the backup roll:

(1) A backup roll shaft wherein said backup roll is mounted on one end portion thereof.

(2) A bearing portion which rotatably supports said backup roll shaft at the opposite side of said end portion.

(3) A supporting portion which supports said bearing portion and extends in the direction away from said backup roll.

The apparatus can comprise a sizing device for sizing the outer diameter of said ring-shaped work to a designated dimension. The sizing device can comprise following matters.

(1) A die having a die hole whose inner shape corresponds to the outer shape of said work.

(2) A punch which pushes said work into said die hole so that said work passes through said die hole, thereby its outer diameter being sized to said designated dimension.

(3) A work supporting portion which is located in front of said die in the pushing direction of said punch and supports said work at a position where the center axis of said work coincides with that of said die hole.

In the sizing device, the work rolled by the forming roll and the mandrel is sized to have a designated outer diameter being pushed into the die, so that the mechanical accuracy of the work improves.

The sizing device can further comprise following matters.

(1) A die holder wherein said die is mounted.

(2) A holder supporting member having an entrance of said die holder and a guide portion which guides said die holder from said entrance to the inside of said holder supporting member.

(3) A clamping device which clamps said die holder to said holder supporting member at a state that said die holder is mounted in said holder supporting member.

According to this constitution, mounting and dismounting the die in and from the sizing device becomes more easy. In a more specific constitution, said die holder is formed in a plate-like shape and has a die mounting hole formed therethrough in its thickness direction. The die is inserted into said die mounting hole from the front side in said pushing direction of said punch, and held by said die holder at a state of the back portion thereof projecting from said die mounting hole. The guide portion comprises a pair of guide grooves formed on both sides of said die supporting member extending from said entrance. The die holder slides along said guide grooves at the both corresponding edge portions thereof, thereby moving to the mounting position. Furthermore, said holder supporting member has a notch portion formed corresponding to said back portion of said die projecting from said die mounting hole so as to allow the projected portion of said die moving with said die holder.

In the constitution described above, a holder stopper can be provided on said holder supporting member in order to locate said die holder in said mounting position. The die holder is to be set against said holder stopper, and then clamped to said holder supporting member with said clamping device.

The holder stopper can be formed inclined with respect to a line perpendicular to the sliding direction of said die holder, and the inner end portion of said die holder can be also inclined corresponding to said holder stopper. The die holder is to be located in said mounting position at a state that the inclined portion of said die holder is urged against said holder stopper, whereby said die holder is urged against the bottom of one of said guide grooves, receiving the force along the inclined direction of said holder stopper.

The die can be inserted unfixedly into the die mounting hole of the die, and a stopper flange can be formed along the font edge portion of the die for preventing the die dropping off from the die hole, whereby the die is to be located precisely in the mounting position. When the work is pushed into the die hole, the die is urged against the surface of the die holder due to the pressing force from the punch.

The work supporting portion in the sizing device can comprise following matters.

(1) A pair of work supporting members provided so as to face each other, which members support said ring-shaped work at the outer surface thereof, and whose supporting surfaces make a designated angle each other.

(2) A moving device which moves said pair of work supporting members to and from each other.

(3) A work urging member which urges said work against said work supporting members.

In this constitution, the apparatus can comprise a work guiding portion for guiding said ring-shaped work, which is unloaded from said mandrel after finishing said rolling, to said work supporting portion in said sizing device. The work supporting portion receives said work guided by said work guiding portion. The apparatus can further comprises a work detecting means which detects said work received by said work supporting portion, and a driving means which drives said work urging member between a position where said work urging member allows said work to be received by said supporting portion, and a position where said work urging member urges said work against said work supporting portion, according to the detecting result of said work detecting means. By this, sizing of the work can be performed more efficiently and precisely since loading the rolled work to the sizing apparatus is carried out automatically and precisely.

DETAILED DESCRIPTION OF THE PREFERRED EMBODIMENTS

Several embodiments of this invention will now be described with reference to drawings.

(Embodiment 1)

Figure 1:
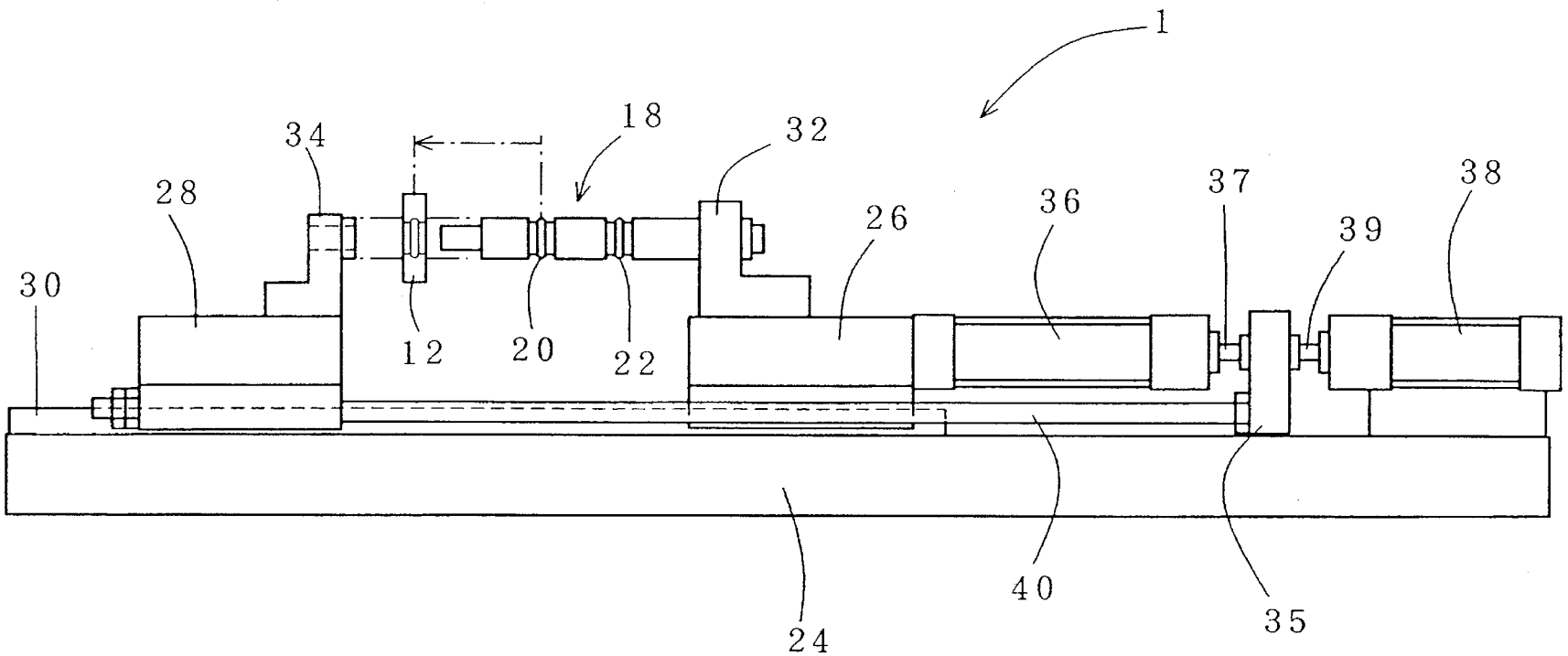
FIG. 1 is a side view of the first embodiment of this invention.
Figure 2:
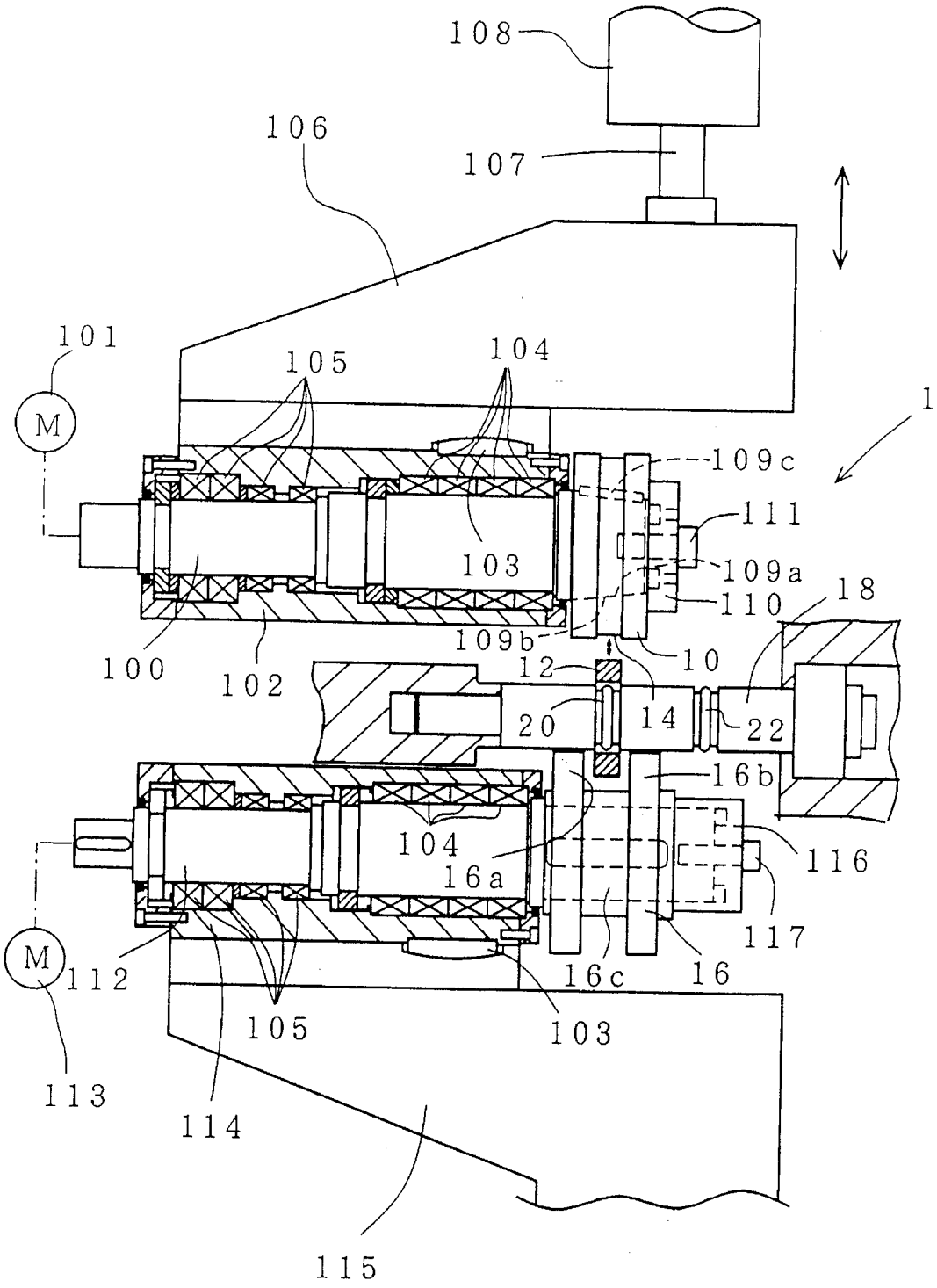
FIG. 2 is an elevation of FIG. 1.

As shown in FIG. 1, in the apparatus for rolling a ringshaped work (which will be called merely as "apparatus" hereinafter) 1 regarding the first embodiment of this invention, a first slider 26 and a second slider 28 are mounted on a table 24 movably along a guide 30 in the axial direction of a mandrel 18. A first supporting bracket (first mandrel supporting portion) 32 and a second supporting bracket (second mandrel supporting portion) 34 are secured on the sliders 26 and 28. As shown in FIG. 2, two forming portions, i.e., the first forming portion 20 and the second forming portion 22 are formed on the surface of the mandrel 18 along the axial direction thereof in a shape of ring-like ribs. Furthermore, as shown in FIG. 2, a forming roll 10 and a backup roll 16 are arranged in the both sides of the mandrel 18 with respect to the axial direction thereof.

The forming roll 10 has a groove 14 having a width corresponding to that of a ring-shaped work (which will be called merely as "work" hereinafter) 12 and mounted removably on one end portion of a forming roll shaft 100 which is driven by a motor 101. In one side of the forming roll 10, the forming roll shaft 100 is supported by a bearing portion 102, which is uniaxially mounted on the forming roll shaft 100 and supports it rotatably by ball bearings 104 and 105. A supporting portion 106 is secured to the bearing portion 102 at one end portion thereof and extends away from the forming roll 10. The forming roll 10 moves to and from the mandrel 18 together with the bearing portion 102 and the supporting portion 106 due to the extension and retraction of a piston rod 107, which is fixed with the supporting portion 106 at its tip and driven by a piston cylinder 108.

Between the bearing portion 102 and the supporting portion 106, an absorber 103 is inserted for making the load applied to the ball bearings 104 and 105 uniform by sliding along the forming roll shaft 100 when the side of the shaft 100 is deflected with the forming roll 10 in a direction opposed to the work 12.

Both mounting surfaces 109*a* and 109*b* of the forming roll shaft 100 and forming roll 10 are tapered so that the diameters of said mounting surfaces 109*a* and 109*b* increase along the direction of mounting said forming roll 10 on the shaft 100 for making the forming roll 10 to be easily dismounted from the shaft 100. The forming roll 10 is inserted into the shaft 100 along the mounting surfaces 109*a* and 109*b*, and fixed by a screw 111 screwed in the tip of the shaft 100, with a holding plate 110. Furthermore, a key 109*c* is inserted between the forming roll 10 and the shaft 100.

On the other hand, the backup roll 16 is mounted on one end portion of a backup roll shaft 112 and driven by a motor 113 which is synchronized with the motor 101 for the forming roll 10. The backup roll 16 is urged against the mandrel 18 from the opposite side of the forming roll 10, thereby receiving the pressure from the forming roll 10 when the work 12 is rolled. Furthermore, the backup roll 16 has roll portions 16*a* and 16*b* which are arranged in both sides of the work 12 so as not to interfere with the work 12. These roll portions 16*a* and 16*b* have a function as guide members regulating the position of the work 12 in the axial direction of the mandrel 18. And roll portions 16*a* and 16*b* are mounted on one end portion of the backup roll shaft 112 along with a backup roll collar 16*c* and fixed by using a hold plate 116 and a screw 117.

As well as for the forming roll 10, the backup roll shaft 112 is supported in one side of the backup roll 16 by a bearing portion 114 which is uniaxially mounted on the backup roll shaft 112 and supports rotatively the shaft 112 by the ball bearings 104 and 105. A supporting portion 115 is secured to the bearing portion 114 at one end portion thereof and extends away from the backup roll 16. The other end of the supporting portion 115 is fixed with the unillustrated main body of the apparatus 1. Furthermore, the absorber 103 is also inserted between the bearing portion 114 and the supporting portion 115.

In FIG. 1, the first supporting bracket 32 is connected with the one end portion of the mandrel 18 and rotatively supporting the end portion with an unillustrated bearing. This first supporting bracket 32 is fixed against the mandrel 18 and moves together with the mandrel 18 in the axial direction thereof. The second supporting bracket 34 is connected with the other end portion of the mandrel 18 and rotatively supports it when the mandrel approaches thereto, and disconnected when the mandrel 18 moves away. On the other hand, a first cylinder 36, as an auxiliary mandrel driving device is connected with the first slider 26 and moves with it. A second cylinder 38 as a mandrel driving device is fixedly mounted on the table 24, whose rods 37 and 39 are joined at each corresponding tip by a joint member 35. Furthermore, one end of a long connecting rod 40 is secured on the joint member 35, and the other end side extends along the mandrel 18 and is connected with the second slider 28. Thus, the first cylinder 36 drives the mandrel 18 along with the first slider 26 and first supporting bracket 32, while the second cylinder 38 moves also the second slider 28 and the second supporting bracket 34 besides the mandrel 18, the first slider 26 and the first supporting bracket 32 by using a connecting rod 40.

Figure 3:
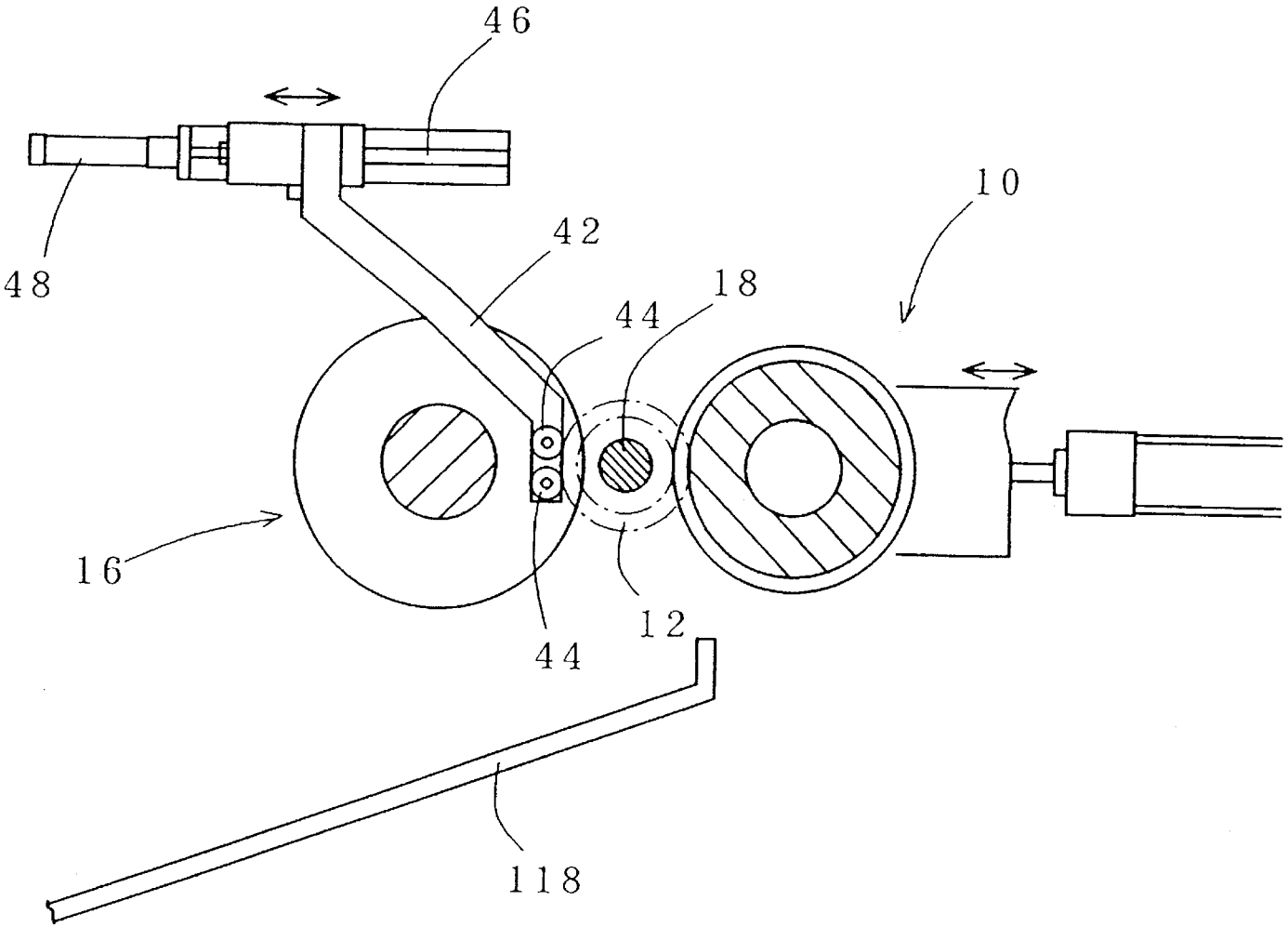
FIG. 3 is a figure explaining the action of the work holding device.

As shown in FIG. 3 and FIG. 7(*a*), a holding arm 42 is inserted between two roll portions 16*a* and 16*b* of the backup roll 16. This holding arm 42 is moved by a cylinder 48 between a position of contacting with the work 12 and a position remote from the work 12 along a guide 46, i.e., in a direction crossing with the axial direction of the mandrel 18. The arm 42 contacts with the work 12 with a roller 44 mounted on the tip thereof and functions as a work holding device for making gap between the work 12 and the first or the second forming portions 20 or 22 cooperating with the forming roll 10. The contacting position of the arm 42 against the work 12 is changeable according to the outer diameter of the work 12, so that the arm 42 also has a function to detect the outer diameter of the work 12.

In FIG. 3, a work guiding passage 118 (work guiding portion) is arranged at a lower level than the mandrel 18 in a position corresponding to the forming roll 10 and the backup roll 16. The work guiding passage 118 extends downward in a transverse direction with respect to the axial direction of the mandrel 18, and it lower end intrudes into a sizing device 120. The work 12 after rolling is unloaded from the mandrel 18 and guided to the sizing device 120 rolling on the guiding passage 118.

Figure 5:
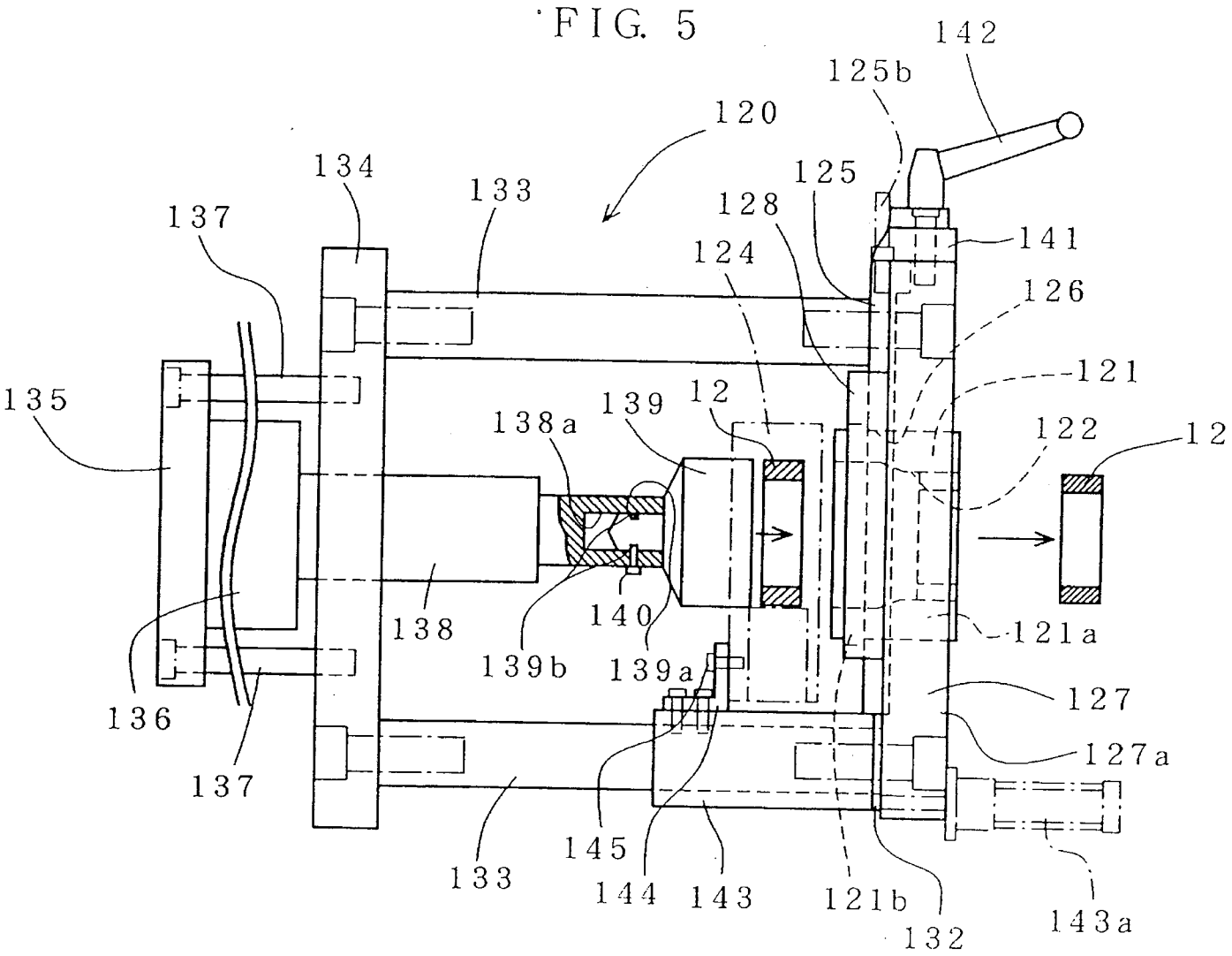
FIG. 5 is a side view of the sizing device.

As shown in FIG. 5, the sizing device 120 is equipped with a die 121 having a die hole 122 for sizing the outer diameter of the work 12, a punch 139 for pushing the work 12 into the die hole 122, and a work supporting member 124 for positioning the work against the die hole 122, and so on. The die 121 is mounted in a die holder 125. The die holder 125 is formed in a plate-like shape and has a die mounting hole 126 formed therethrough in its thickness direction. The die 121 is removably and unfixedly inserted into the die mounting hole 126 from the front side of the pushing direction of the punch 139, and held by the die holder 125 at a state of the back portion thereof projecting from the die mounting hole 126.

The die holder 125 is mounted in a holder supporting member 127. The holder supporting member 127 has a plate-like main body 127*a*, which is to be overlapped with the die holder 125, and guide portions 128 (FIG. 6) which correspond to both edge portions in the width of the die holder 125 and are secured on the plate surface of the main body 127*a* by using screws. Each guide portion 128 has a guide groove 129 formed on the part corresponding to the edge portions of the main body 127*a*. The die holder 125 is inserted into the holder supporting member 127 from an entrance 130 formed at the upper part of the guide grooves 129, and slides along the guide grooves 129 at the both edge portions thereof, thereby moving to a designated mounting position. On the other hand, a U-shaped notch portion 131 is formed in the main body 127*a* of the holder supporting member 127 corresponding to the back portion of the die 121 projecting from the die mounting hole 126 (FIG. 5), thereby allowing the projected portion of the die 121 moving with the die holder 125.

As shown in FIG. 5, the main body 127*a* of the holder supporting member 127 is connected with a frame plate 134 by rods 133 at the four corners of the front surface thereof. A cylinder 136 is supported by a supporting plate 135 which is connected with the front surface of the frame plate 134 by rods 137. From the cylinder 136, a piston rod 138 extends toward the die 121 through the frame plate 134. The punch 139 is removably mounted on the tip of the piston rod 138 and moves to and from the die 121 due to the extension and retraction of the piston rod 138. This punch 139 has a mounting portion 139*a* fitting into a mounting hole 138*a* formed on the tip of the piston rod 138. A groove 139*b* is formed on the outer surface of the mounting portion 139*a*, and a set screw 140 is screwed into the groove 139*b* through the side wall of the piston rod 138, thereby setting the punch 139 onto the piston rod 138.

Figure 6:
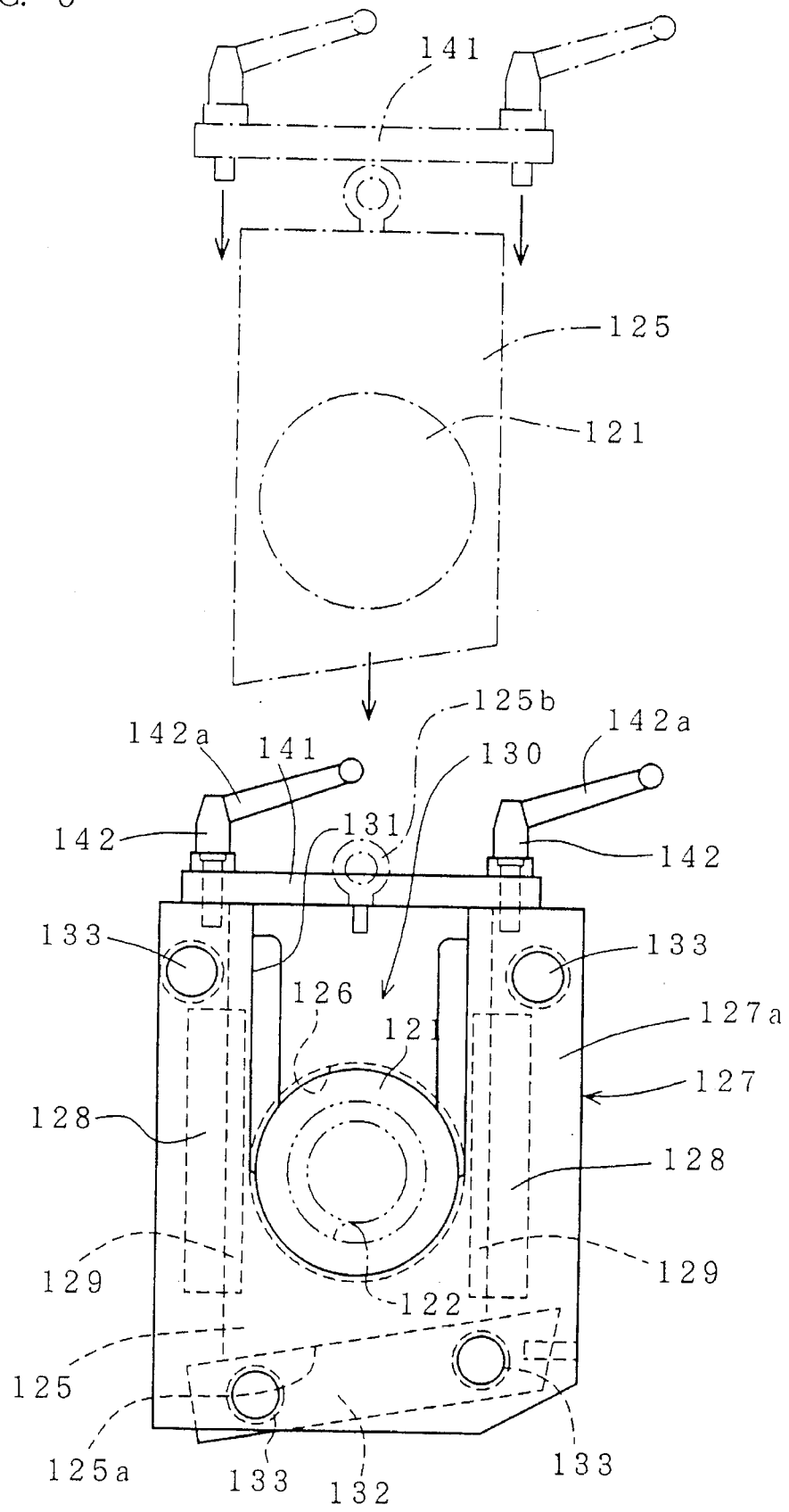
FIG. 6 is a front view of FIG. 5.
Figure 7A:
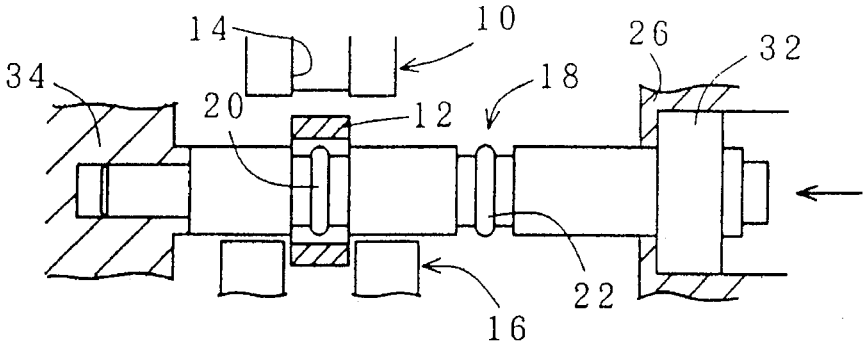
FIG. 7*a* to *e* are figures explaining the process of rolling a work by using the apparatus in FIG. 1.
Figure 7B:
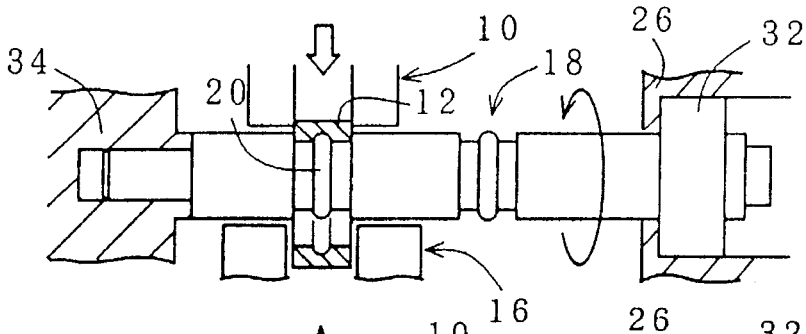
Figure 7C:
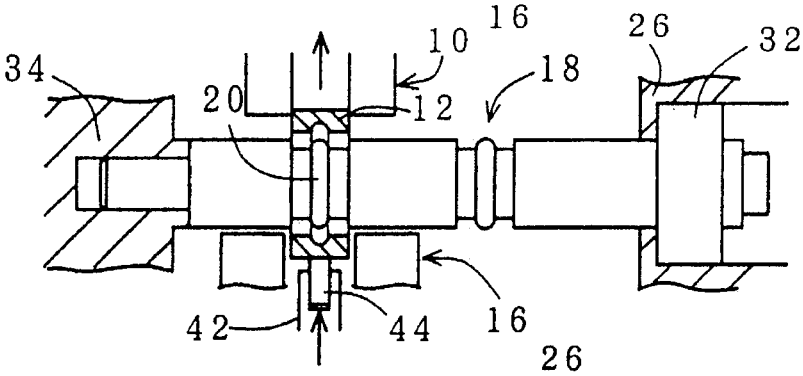
Figure 7D:
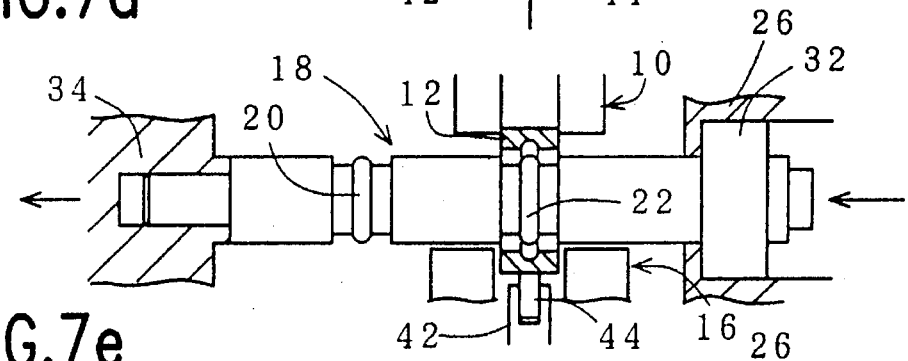
Figure 7E:
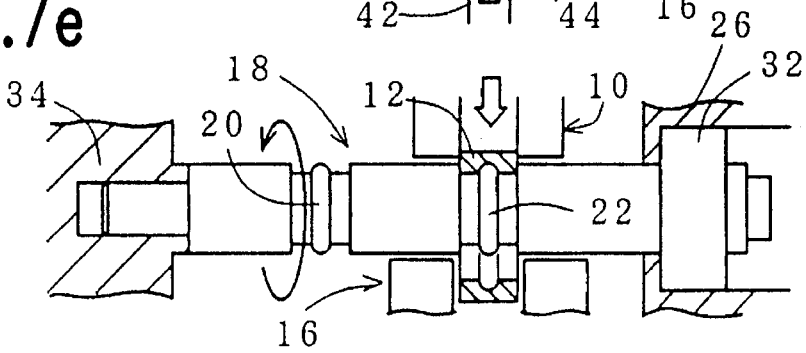

As shown in FIG. 6, a holder stopper 132 is mounted on the front surface of the holder supporting member 127. As shown in FIG. 5, the holder stopper 132 is located in the lower portion of the holder supporting member 127, and as shown in FIG. 6, it is formed inclined with respect to a line perpendicular to the sliding direction of the die holder 125, wherein two of the rods 133 is passing therethrough at its opposite end portions of the width. Corresponding to this, an inclined portion 125*a* is formed on the inner end portion of the die holder 125. Furthermore, a hanging hook 125*b* is screwed into the top surface of the die holder 125.

The die holder 125 is stopped its sliding along the guide grooves 129 by the holder stopper 132, and to be located in the mounting position at a state that the top portion is slightly projected over the top surface of the main body 127*a* of the holder supporting member 127. Then, an urging member 141 is located on the top surfaces of the die holder 125 and the main body 127*a*, and two clamp screws 142, each of which has a handle 142*a*, are screwed into the two end portions of said top surface through the urging member 141. The clamp screws 142 urge the die holder 125 against the holder stopper 132 through the urging member 141, thereby clamping the die holder 125 to the holder supporting member 127. As shown in FIG. 5, the die 121 is to be located in a position where the center axis of the die hole 122 coincides with that of the punch 139 (mounting position).

Furthermore, as shown in FIG. 6, the inclined portion 125*a* of the die holder 125 is urged against the holder stopper 132, and in the downward side of the inclined holder stopper 132, the edge portion of the die holder 125 is urged against the bottom of corresponding the guide groove 129, receiving the force along the inclined direction of the holder stopper 132. In this embodiment, the urging member 141 and clamp screws 142 constitute the clamp device.

In FIG. 5, although the die 121 is inserted unfixedly into the die mounting hole 126, a stopper flange 121*b* is formed along the front edge portion of the die 121, and prevents the die 121 dropping off from the die hole 126, so that the die 121 is to be located precisely in the mounting position. When the work 12 is pushed into the die hole 126, the die 121 is urged against the die holder 125 at the circumferential region of the die hole 126 due to the pressing force from the punch 139.

Figure 4:
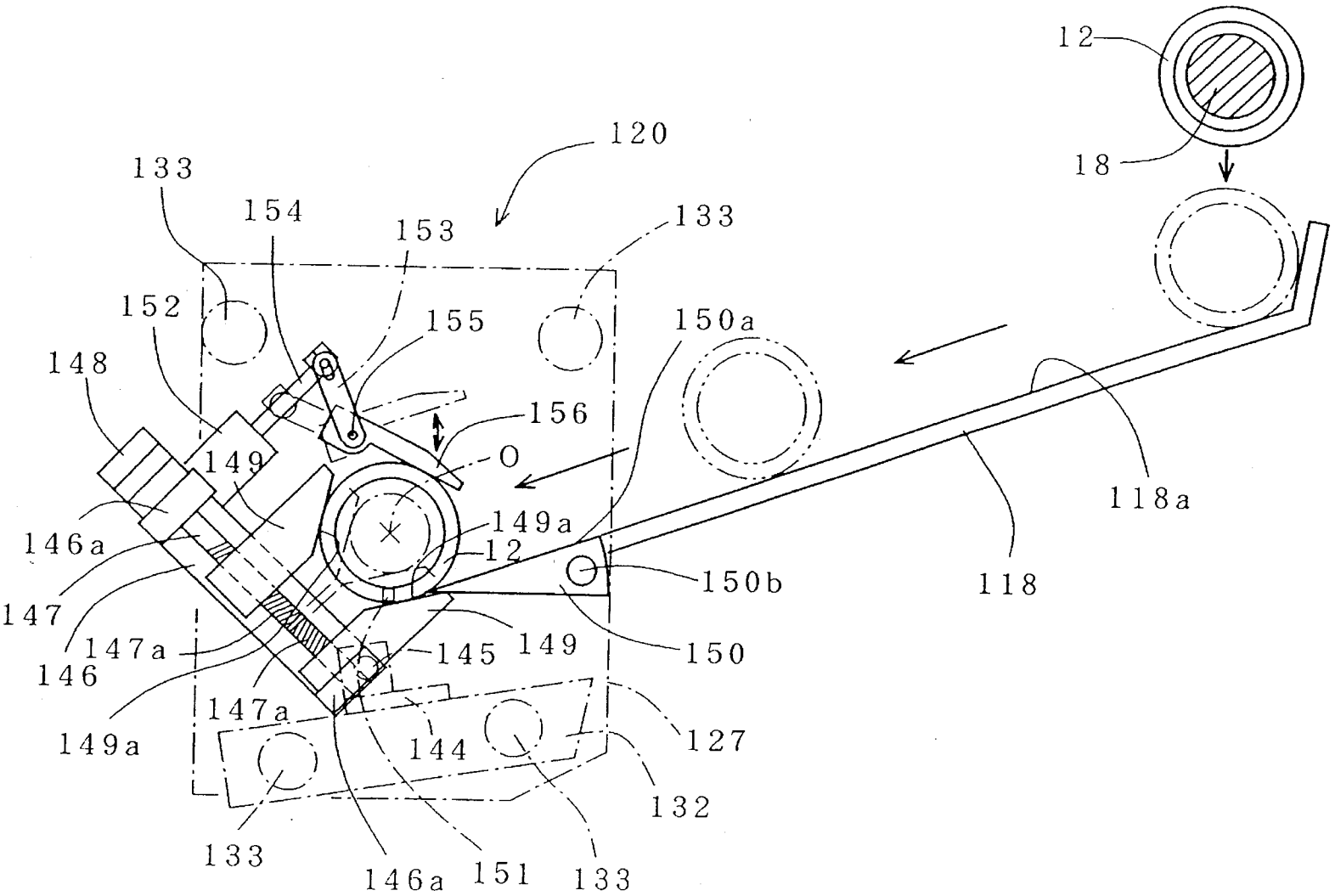
FIG. 4 is a front view of the work supporting porion in the sizing device.

Next, as shown in FIG. 5, the work supporting portion 124 is attached to a supporting portion 144 which is secured to a slide member 143 between the punch 139 and the die 121. The slide member 143 is moved front-to-back by a cylinder 143*a* guided along one or both of rods 133, for enabling the attach or detach of the die 121 to the die holder 125 in a sufficient space. As shown in FIG. 4, in the structure of the work supporting portion 124, two end portions of a threaded shaft 147, having two external threads 147*a* threaded thereon in opposite directions, are rotatably supported by two bearing portions 146*a* formed on opposite ends of a frame 146. And an adjusting dial 148 is attached to one end of the threaded shaft 147 for its rotation. A pair of work supporting members 149 are screwed on these external threads 147*a*, respectively, and moved to and from each other by the rotation of the threaded shaft 147. These work supporting members 149 support the work 12 from below in two directions, and the supporting surfaces 149*a* are inclined, making a designated angle each other. The distance between these work supporting members 149 is adjusted according to the outer diameter of the work 12 for setting the center axis O of the work 12 with that of the die hole 126.

Corresponding to one of the work supporting members 149, a work guiding member 150, whose upper surface is a guide surface 150*a* continuing to the supporting surface 149*a* of said work supporting member 149, is rotatably attached to the holder supporting member 127 with a pin 150*b* so as to be able to keep its angular position around the pin 150*b* due to the friction therebetween. The exit of the work guiding passage 118 is located adjacent to the work guiding member 150, and the transporting surface 118*a* thereof is continuing to the guiding surface 150*a* of the member 150 so that the work rolled down on the transporting surface 118*a* is received by the pair of work supporting member 149 at the supporting surfaces 149*a* thereof.

A work detecting element 151, such as a reflection or transmission type of optical sensor, an ultrasonic sensor, a proximity switch, and so on, is arranged adjacent to the supporting surface 149*a* of the work supporting member 149 located closer to the work guiding member 150, and detects the work 12 received by the supporting member 149. A cylinder 152 as a driving means, which extends and retracts a piston rod 154, is secured on the upper surface of the frame 146. One end of a link 153 is connected rotatably and slidably in its own longitudinal direction with the tip of the piston rod 154, while the other end thereof is rotatably connected with one end portion of a work urging member 156 by a fixed shaft 155. The angle between the link 153 and the work urging member 156 can be set at an arbitrary angle due to the friction from the shaft 155, and the angle is adjustable corresponding to the outer diameter of the work 12. The urging member 156 moves up and allows the work supporting members 149 to accept the work when the piston rod 154 is retracted, and urges the work against the supporting members 149 when the piston rod 154 is extended.

Now, the operation of the embodiment is going to be explained in the following.

As shown in FIG. 7(*a*), a work 12 is set in the forming position at a state that the forming roll 10 is retracted, and the mandrel 18 is disconnected from the second supporting bracket 34 as shown in FIG. 1. Then, the first slider 26, the first supporting bracket 32 and the mandrel 18 are moved simultaneously to the left in the figure by the first cylinder 36 (FIG. 1), and the end portion of the mandrel 18 is set into the bearing of the second supporting bracket 34, passing through the work 12. At this time, the first forming portion 20 of the mandrel 18 is located in the forming position corresponding to the forming roll 10. Next, as shown in FIG. 7(*b*), the forming roll 10 approaches to the mandrel 18, and the work 12 is pressed between the roll 10 and the first forming portion 20 from outside and inside. The forming roll 10, the mandrel 18 and the work 12 are rotated together in this state, and the first rolling step is performed for forming a groove on the inner surface of the work 12.

As shown in (c), after finishing the first rolling step, the holding arm 42 (the roller 44) approaches to the mandrel 18, holds the work 12 cooperating with the forming roll 10, and moves perpendicularly to the axial direction of the mandrel 18, thereby forming a gap between the inner surface of the work 12 and the first forming portion 20. In this state, as shown in (d), the second cylinder 38 drives the mandrel 18, the first supporting bracket 32 and the second supporting bracket 34 to the left in the figure, and locate the second forming portion 22 in the forming position. Then, as shown in (e), the forming roll 10 approaches to the mandrel 18 again, and the forming roll 10, the mandrel 18 and the work 12 are rotated together for performing the second step of he rolling.

When the second step is finished, the holding arm 42 approaches to the work again to hold it and makes a gap between he mandrel 18 cooperating with the forming roll 10. After that, the mandrel 18 retracts in its axial direction for unloading the work 12. The unloaded work 12 falls to the work guiding passage 118. The retraction of the mandrel 18 is performed by the first cylinder 36 and the second cylinder 38 (FIG. 1). Thus, both the first and second supporting brackets 32 and 34 are moved with the mandrel 18 in the same direction by the second cylinder 38, while only the first supporting bracket 32 and the mandrel 18 are moved by the first cylinder 36 without any accompanied motion of the second supporting bracket 32, for disconnecting the mandrel 18 from the second supporting bracket 34.

As shown in FIG. 4, the unloaded work 12 rolls on the guiding passage 118, passes on the work guiding member 150, and then is received by the work supporting member 149 at the supporting surfaces 149*a*. The distance between the work supporting members 149 is preliminarily adjusted so as to set the center axis of the work 12 to the center 0 of the die hole 126. The work urging member 156 is moved up for receiving the work 12. When the work is detected by the work detecting element 151, an unillustrated control unit receives the detection signal from the element 151 and operates the cylinder 152, and the urging member 156 falls down to the work 12 and urges it against the work supporting members 149.

In this state, as shown in FIG. 5, the cylinder 136 operates the punch 139 thereby urging the work against the die 121. The work 12 is pushed into the die hole 126 and discharged from back side, passing through the die hole 126. The die hole 126 has an inner diameter which is a little smaller than the outer diameter of the work 12, so that the outer diameter of the work 12 is sized down to the dimension corresponding to the inner diameter of the die hole 126. On the other hand, the outer diameter of the punch 139 is slightly smaller than the die hole 126 for preventing the die 121 being withdrawn along with the punch 139 due to the friction when the punch 139 retracts from the die holder 125.

(Embodiment 2)

Figure 8:
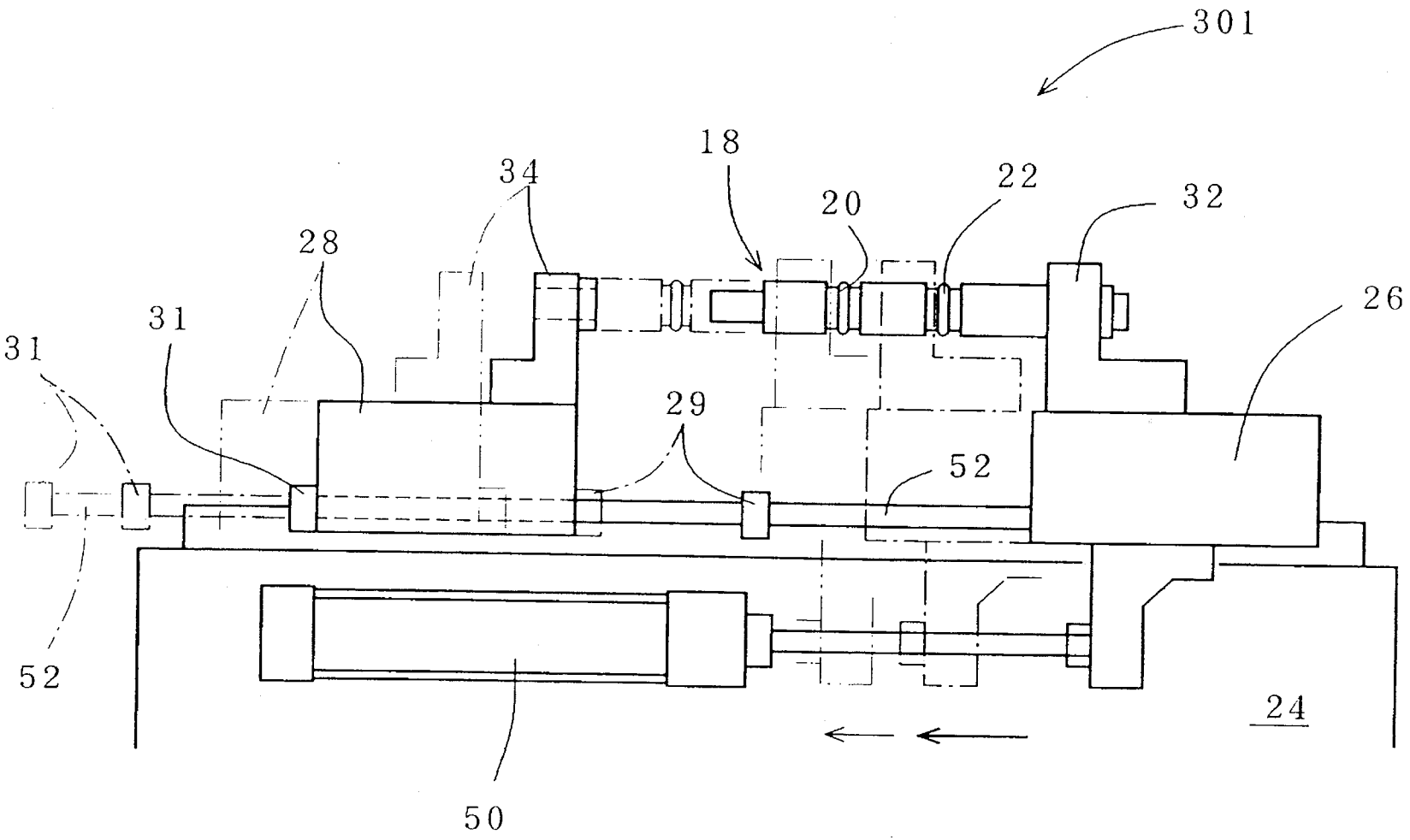
FIG. 8 is a side view of the second embodiment of this invention.

FIG. 8 shows an apparatus regarding the second embodiment of this invention. The apparatus 301 has only one cylinder 50 for driving the mandrel 18 in its axial direction. This cylinder 50 is located lower than the upper surface of the table 24, so that the cylinder 50 does not project backward too much and can reduce the size of the apparatus. In this embodiment, when the first slider 26 reaches to a designated position, a stopper 29, which is fixed in the middle of the nod 52 passing through the second slider 28, contacts with the second slider 28, thereby moving the second slider with the first slider 26. During the retraction of the first slider 26, the second slider 28 is moved in the same direction by a stopper 31 formed on the tip of the rod 52, and stopped by an unillustrated stopper. This embodiment can be constituted as the one comprising the same type of sizing device for the embodiment 1.

(Embodiment 3)

Figure 9A:
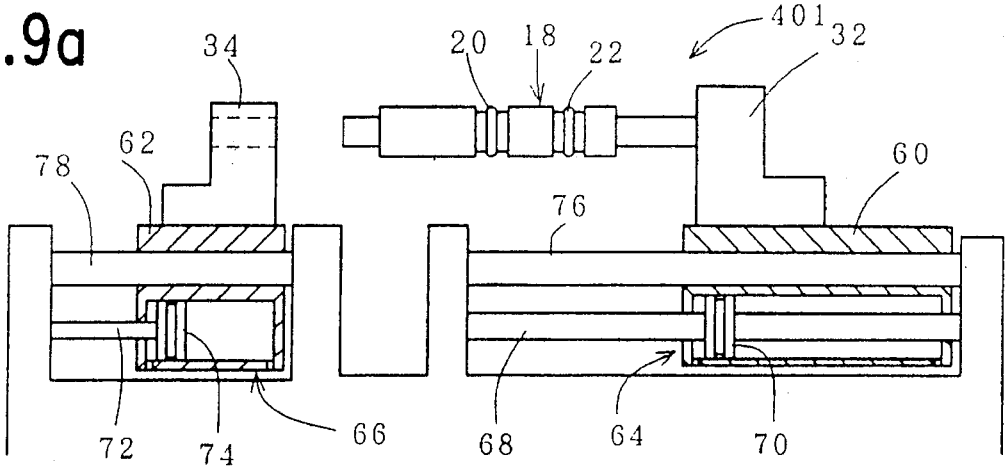
FIG. 9*a* to *c* are side views of the third embodiment of this invention.
Figure 9B:
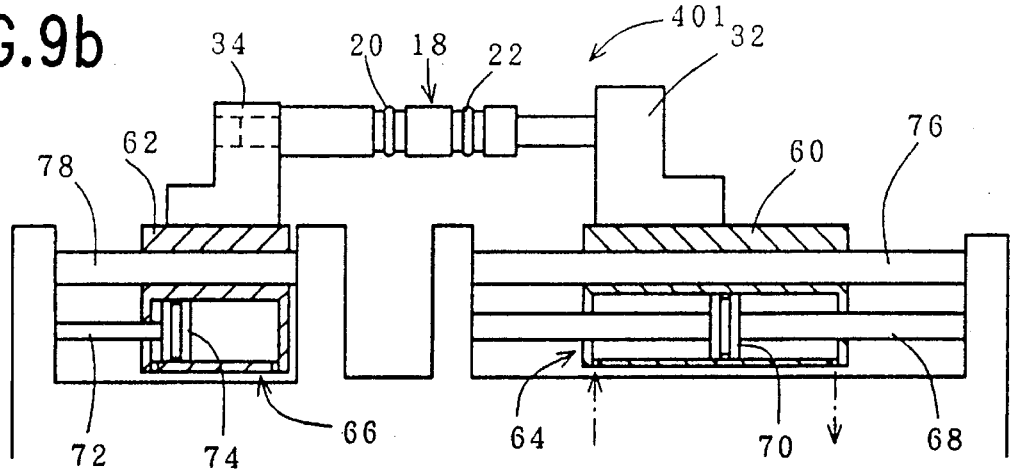
Figure 9C:
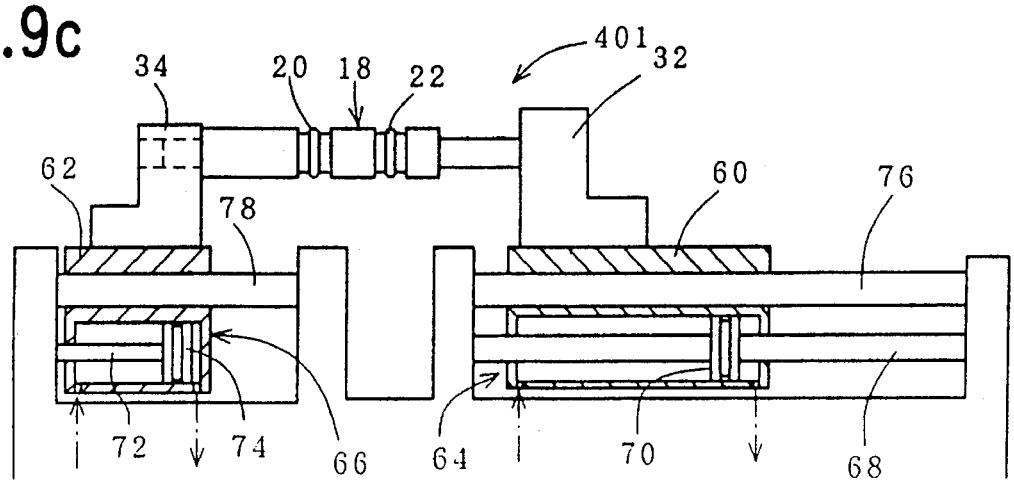

FIG. 9(*a*) shows an apparatus regarding the third embodiment of this invention. In the apparatus 401, the first and second brackets 32 and 34 are fixed on first and second bases 60 and 62, and a hydraulic cylinders 64 and a second hydraulic cylinder 66 are installed on the first and second bases 60 and 62, respectively. Piston rods 68 and 72 and pistons 70 and 74 thereof are fixedly mounted, and the first and second bases 60 and 62 drive the mandrel 18 in its axial direction guided by guide rods 76 and 78, according to a selective supply of fluid to one of compartments of the first and second hydraulic cylinders 64 and 66, which are separated by the pistons 70 and 74, respectively.

In the constitution mentioned above, the first supporting bracket 32 and the mandrel 18 are first moved to the left in the figure by the first hydraulic cylinder 64. Then, as shown in (b), the first step of the rolling is performed when the end portion of the mandrel 18 is connected with the second supporting bracket 34. After that, the first and second supporting brackets 32 and 34 are moved simultaneously and synchronously to the left in the figure by the second hydraulic cylinder 66, and then the second step of the rolling is performed by the second forming portion 22 as shown in FIG. (c). According to this embodiment, each base can be moved more accurately, and the size of the apparatus can be reduced.

Figure 10A:
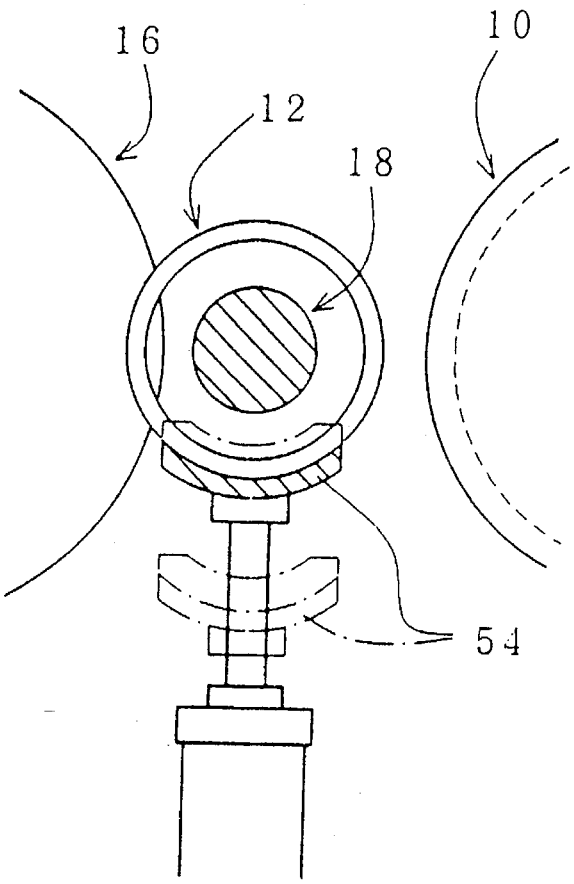
FIG. 10*a* and *b* are front views showing several modifications of work holding device.
Figure 10B:
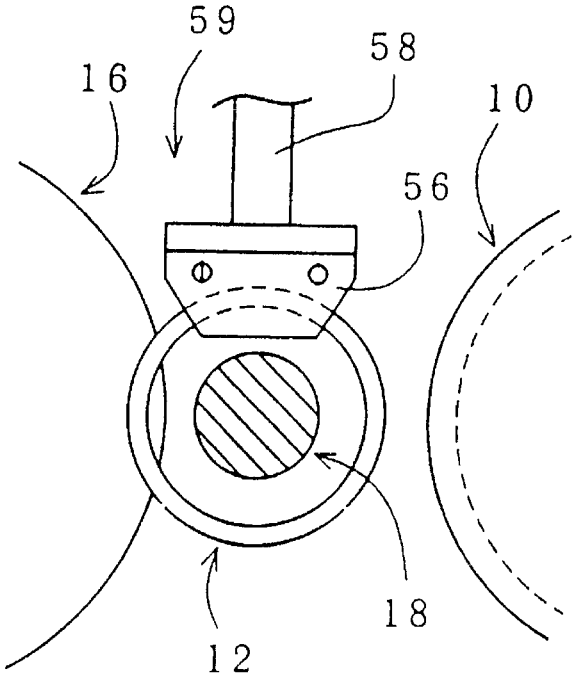
Figure 11:
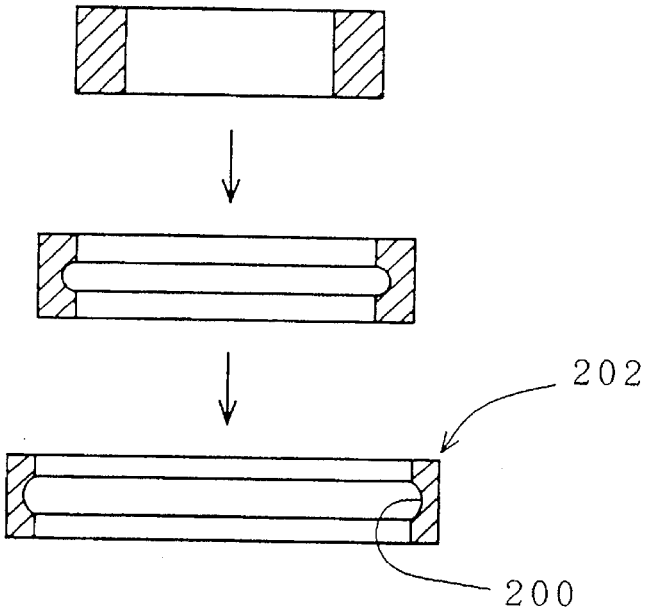
FIG. 11 is a figure explaining a process for forming a groove on the inner surface of a ring-shaped work by performing a rolling step by step.
Figure 12:
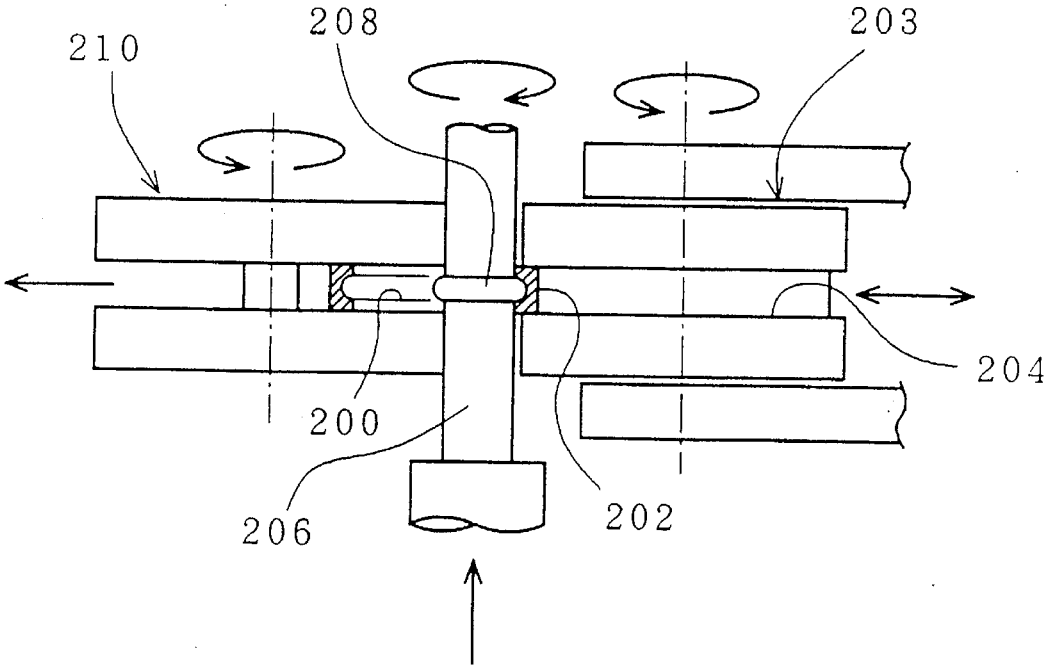
FIG. 12 is an elevation of a rolling apparatus in a prior art.

The embodiments presented above are mere examples of several possibilities, and it is possible to add various modifications according to knowledge of person skilled in the art. For example, as shown in FIG. 10(*a*), the work 12 can be supported from below by a supporting member 54. On the other hand, as shown in FIG. 10(*b*), a work loader 59 can be added to the embodiment. This loader 59 has an elevating rod 58 which is held over the mandrel 18 and equipped with a chuck 56 on its lower end portion.

That which claimed is:

1. An apparatus for rolling a ring-shaped work comprising:

a forming roll contacted with the outer surface of a ring-shaped work;

a mandrel provided movably in the axial direction thereof;

a plurality of forming portions formed on the outer surface of said mandrel, wherein said forming portions are arranged at an arbitrary distance along the axial direction of said mandrel, wherein one of said forming portions is selected according to the moving distance of said mandrel in said axial direction, and said selected forming portion is contacted with the inner surface of said work for rolling the work with a cooperation of said forming roll;

a mandrel driving device which drives said mandrel in said axial direction for selecting one of said forming portions, a mandrel backup roll;

a work holding device inserted between said backup roll and said work which holds said work for making a gap between said work and said forming portions when said mandrel is axially moved for selecting one of said forming portions.

2. An apparatus for rolling a ring-shaped work according to claim 1, wherein at least two of said forming portions are subsequently selected for rolling said work step by step.

3. An apparatus for rolling a ring-shaped work according to claim 2, wherein each said forming portion is provided for forming a different depth of groove on the inner surface of said work and selected subsequently for rolling said work step by step in the order of increasing the depth of said groove.

4. An apparatus for rolling a ring-shaped work according to claim 1 comprising;

a first mandrel supporting portion which rotatably supports one end portion of said mandrel;

a second mandrel supporting portion which rotatably supports the other end portion of said mandrel and can move to and from said other end portion.

5. An apparatus for rolling a ring-shaped work according to claim 4 comprising an auxiliary mandrel driving device which drives said first mandrel supporting portion together with said mandrel in said axial direction for loading and unloading said work on and from said mandrel from said other end portion;

and wherein said mandrel driving device drives said first and second mandrel supporting portions together with said mandrel in said axial direction.

6. An apparatus for rolling a ring-shaped work according to claim 1 comprising;

a forming roll shaft wherein said forming roll is mounted on one end portion thereof;

a bearing portion which rotatably supports said forming roll shaft at the opposite side of said edge portion;

a supporting portion which supports said bearing portion and extends away from said forming roll.

7. An apparatus for rolling a ring-shaped work according to claim 6, wherein said forming roll is removably mounted on said one end portion of said forming roll shaft, and wherein both mounting surfaces of said forming roll shaft and said forming roll are tapered so that the diameters of said mounting surfaces increase along the direction of mounting said forming roll.

8. An apparatus for rolling a ring-shaped work according to claim 1 comprising;

a backup roll which is provided corresponding to said forming roll and urged against said mandrel from the opposite side of said forming roll, thereby receiving the pressure from said forming roll when said ring-shaped work is rolled;

a backup roll shaft wherein said backup roll is mounted on one end portion thereof;

a bearing portion which rotatably supports said backup roll shaft at the opposite side of said end portion;

a supporting portion which supports said bearing portion and extends away from said backup roll on said forming roll shaft.

9. An apparatus for rolling a ring-shaped work according to claim 1, comprising a sizing device for sizing the outer diameter of said ring-shaped work to a designated dimension, and said sizing device comprising;

a die having a die hole whose inner shape corresponds to the outer shape of said work;

a punch which pushes said work into said die hole so that said work passes through said die hole, thereby its outer diameter being sized to said designated dimension;

a work supporting portion which is located in front of said die in the pushing direction of said punch and supports said work at a position where the center axis of said work coincides with that of said die hole.

10. An apparatus for rolling a ring-shaped work according to claim 9, wherein said sizing device further comprising;

a die holder wherein said die is mounted;

a holder supporting member having an entrance of said die holder and a guide portion which guides said die holder from said entrance to the inside of said holder supporting member;

a clamping device which clamps said die holder to said holder supporting member at a state that said die holder is mounted in said holder supporting member.

11. An apparatus for rolling a ring-shaped work according to claim 10, wherein said die holder is formed in a plate-like shape and has a die mounting hole formed therethrough in its thickness direction;

wherein said die is inserted into said die mounting hole from the front side in said pushing direction of said punch, and held by said die holder at a state of the back portion thereof projecting from said die mounting hole;

wherein said guide portion comprises a pair of guide grooves formed on both corresponding edges of said die supporting member extending from said entrance;

wherein said die holder slides along said guide grooves at the both side portions thereof, thereby moving to the mounting position;

and wherein said holder supporting member has a notch portion formed corresponding to said back portion of said die projecting from said die mounting hole so as to allow the projected portion of said die moving with said die holder.

12. An apparatus for rolling a ring-shaped work according to claim 11, wherein a holder stopper is provided on said holder supporting member in order to locate said die holder in said mounting position;

wherein said die holder is set against said holder stopper, and then clamped to said holder supporting member with said clamping device;

wherein said holder stopper is formed inclined with respect to a line perpendicular to the sliding direction of said die holder;

wherein the inner end portion of said die holder is also inclined corresponding to said holder stopper;

and wherein said die holder is to be located in said mounting position at a state that the inclined portion of said die holder is urged against said holder stopper, whereby said die holder is urged against the bottom of one of said guide grooves receiving the force along the inclined direction of said holder stopper.

13. An apparatus for rolling a ring-shaped work according to claim 9, wherein said work supporting portion comprising;

a pair of work supporting members provided so as to face each other, which members support said ring-shaped work at the outer surface thereof, and whose supporting surfaces make a designated angle each other;

a moving device which moves said pair of work supporting members to and from each other;

a work urging member which urges said work against said work supporting members.

14. An apparatus for rolling a ring-shaped work according to claim 13 comprising;

a work guiding portion for guiding said ring-shaped work, which is unloaded from said mandrel after finishing said rolling, to said work supporting portion in said sizing device;

said work supporting portion receiving said work guided by said work guiding portion;

a work detecting means which detects said work received by said work supporting portion;

a driving means which drives said work urging member between a position where said pusher accepts said work to be received by said supporting portion, and a position where said work urging member urges said work against said work supporting portion, according to the detecting result of said work detecting means.

15. An Apparatus for rolling a ring-shaped work according to claim 1, wherein said backup roll has two roll portions which are arranged on both sides of the work so as not to interfere with said work; and wherein said work holding device is arranged between said two roll portions of said backup roll.

16. An Apparatus for rolling a ring-shaped work according to claim 15, wherein said work holding device comprises a holding arm which is inserted between said two roll portions of said backup roll, which is movable between a position of contacting with said work and a position remote from said work in a direction crossing with the axial direction of said mandrel, and which makes gap between said work and said mandrel cooperating with said forming roll.

17. An Apparatus for rolling a ring-shaped work according to claim 15, wherein said arm contacts with said work with a roller mounted on the tip thereof; and wherein the contacting position of said arm against said work is changeable according to the outer diameter of said work.

18. An Apparatus for rolling a ring shaped work according to claim 1, wherein said backup roll is fixed to a main body of said apparatus.

19. An Apparatus for rolling a ring-shaped work comprising:

a forming roll contacted with the outer surface of a ring-shaped work;

a mandrel provided movably in the axial direction thereof;

a plurality of forming portions formed on the outer surface of said mandrel, wherein said forming portions are arranged at an arbitrary distance along the axial direction of said mandrel, wherein one of said forming portions is selected according to the moving distance of said mandrel in said axial direction, and said selected forming portion is contacted with the inner surface of said work for rolling the work with a cooperation of said forming roll;

a mandrel driving device which drives said mandrel in said axial direction for selecting one of said forming portions;

a work holding device which holds said work for making a gap between said work and said forming portions when said mandrel is axially moved for selecting one of said forming portions;

a forming roll shaft wherein said forming roll is mounted on one end portion thereof;

a bearing portion which rotatably supports said forming roll shaft at the opposite side of said end portion;

a supporting portion which supports said bearing portion and extends away from said forming roll;

wherein said forming roll is removably mounted on said one end portion of said forming roll shaft, and wherein both mounting surfaces of said forming roll shaft and said forming roll are tapered so that the diameters of said mounting surfaces increase along the direction of mounting said forming roll.

20. An Apparatus for rolling a ring-shaped work comprising:

a forming roll contacted with the outer surface of a ring-shaped work;

a mandrel provided movably in the axial direction thereof;

a plurality of forming portions formed on the outer surface of said mandrel, wherein said forming portions are arranged at an arbitrary distance along the axial direction of said mandrel, wherein said forming portions are arranged at an arbitrary distance along the axial direction of said mandrel, wherein one of said forming portions is selected according to the moving distance of said mandrel in said axial direction, and said selected forming portion is contacted with the inner surface of said work for rolling the work with a cooperation of said forming roll;

a mandrel driving device which drives said mandrel in said axial direction for selecting one of said forming portions;

a work holding device which holds said work for making a gap between said work and said forming portions when said mandrel is axially moved for selecting one of said forming portions;

a sizing device for sizing the outer diameter of said ring-shaped work to a designated dimension, and said sizing device comprising;

a die having a die hole whose inner shape corresponds to the outer shape of said work;

a punch which pushes said work into said die hole so that said work passes through said die hole, thereby its outer diameter being sized to said designated dimension;

a work supporting portion which is located in front of said die in the pushing direction of said punch and supports said work at a position where the center axis of said work coincides with that of said die hole;

a die holder wherein said die is mounted;

a holder supporting member having an entrance of said die holder and a guide portion which guides said die holder from said entrance to the inside of said holder supporting member;

a clamping device which clamps said die holder to said holder supporting member at a state that said die holder is mounted in said holder supporting member;

wherein said die holder is formed in a plate-like shape and has a die mounting hole formed therethrough in its thickness direction; and wherein said die is inserted into said die mounting hole from the front side in said pushing direction of said punch, and held by said die holder at a state of the back portion thereof projecting from said die mounting hole;

wherein said guide portion comprises a pair of guide grooves formed on both corresponding edges of said die supporting member extending from said entrance;

wherein said die holder slides along said guide grooves at both side portions thereof, thereby moving to the mounting position;

and wherein said holder supporting member has a notch portion formed corresponding to said back portion of said die projecting from said die mounting hole so as to allow the projected portion of said die moving with said die holder.

21. An Apparatus for rolling a ring-shaped work according to claim 20, wherein a holder stopper is provided on said holder supporting member in order to locate said die holder in said mounting position;

wherein said die holder is set against said holder stopper, and then clamped to said holder supporting member with said clamping device;

wherein said holder stopper is formed inclined with respect to a line perpendicular to the sliding direction of said die holder;

wherein the inner end portion of said die holder is also inclined corresponding to said holder stopper;

and wherein said die holder is to be located in said mounting position at a state that the inclined portion of said die holder is urged against said holder stopper, whereby said die holder is urged against the bottom of one of said guide grooves receiving the force along the inclined direction of said holder stopper.

* * * * *